US005898022A

United States Patent [19]

Maples

[11] Patent Number: 5,898,022

[45] **Date of Patent: *Apr. 27, 1999**

[54] DRY LUBRICANT

[76] Inventor: Paul D. Maples, 3198 Beachcomber Dr., Morro Bay, Calif. 93442

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/666,046

[22] Filed: Jun. 19, 1996

Related U.S. Application Data

[63] Continuation-in-part of application No. 08/566,680, Dec. 4, 1995, Pat. No. 5,670,463, which is a continuation-in-part of application No. 08/209,217, Mar. 11, 1994, Pat. No. 5,472,625.

[51] Int. Cl.[6] ..... C10M 125/00

[52] U.S. Cl. ..... 508/113; 508/155; 508/181; 508/459; 508/488; 508/539

[58] Field of Search ..... 508/488, 539, 508/459, 113, 155, 150, 181

[56] References Cited

U.S. PATENT DOCUMENTS

| | | | |
|---|---|---|---|
| 1,694,148 | 12/1928 | Spalding | 252/39 |
| 1,920,202 | 8/1933 | Lange | 252/39 |
| 1,935,588 | 11/1933 | Cabot . | |
| 1,953,904 | 4/1934 | Bowyer | 252/36 |
| 2,386,553 | 10/1945 | Hilliker . | |
| 2,391,113 | 12/1945 | Zimmer | 252/36 |
| 2,393,797 | 1/1946 | Morgan | 252/36 |
| 2,419,713 | 4/1947 | Flood | 252/36 |
| 2,444,357 | 6/1948 | Maguire | 252/36 |
| 3,201,361 | 8/1965 | Aron . | |
| 3,692,678 | 9/1972 | Stiffler | 252/37 |
| 4,260,500 | 4/1981 | Forsberg . | |
| 5,213,180 | 5/1993 | Masonek et al. . | |
| 5,472,625 | 12/1995 | Maples | 508/488 |

OTHER PUBLICATIONS

Holiday Catalog from Performance Bicycle (Dec. 1997).

*Primary Examiner*—Jacqueline V. Howard
*Assistant Examiner*—Cephia D. Toomer
*Attorney, Agent, or Firm*—Knobbe Martens Olson & Bear, LLP

[57] ABSTRACT

A light-duty, multi-purpose lubricant particularly formulated for use on the diverse bearing surfaces mechanisms which operate in a dirty or dusty environment, such as bicycle chains. The lubricant comprises an insoluble bond weakening agent, preferably metallic soaps such as Calcium Stearate, in suspension in a volatile solvent-based solution of wax and oil. After application and evaporation of the solvent the composite dry lubricant exhibits good penetration and load bearing properties without the dirt-retaining character of oils or greases. The undissolved particles of the bond weakening agent combine with dirt particles to breakdown portions of the lubricant into a dry flaky particles which are sloughed off the mechanism. Soluble waxes having different solid phase crystalline structures may be blended with the paraffin to reduce the rate of sloughing. The amount of solvent may be adjusted or eliminated depending on the application. A surfactant can be added provide for coating wet mechanisms.

33 Claims, No Drawings

DRY LUBRICANT

PRIOR APPLICATION

This is a continuation-in-part application of application Ser. No. 08/566,680 filed Dec. 4, 1995, now U.S. Pat. No. 5,670,463, which is a continuation-in-part of application Ser. No. 08/209,217 filed Mar. 11, 1994, now U.S. Pat. No. 5,472,625, which is incorporated herein by reference.

FIELD OF THE INVENTION

This invention relates to lubricants, and more particularly to the lubrication of mechanisms such as bicycle chains which are typically exposed to dirty or dusty environments.

BACKGROUND OF THE INVENTION

A bicycle chain is a complex structure that incorporates different mechanisms with specific and often contradictory lubrication requirements.

In the first place, a bicycle chain operates in a very dusty environment. Accordingly, its lubricant should be non-tacky, that is dry or of a low viscosity. This requirement would normally exclude greases in favor of solid lubricants. Indeed, any mineral dust collected by a tacky lubricant will eventually cause abrasion and rapid wear of bearing surfaces. The low pressure, low velocity and limited intermittent frictional movement between the lateral link plates of the chain can be adequately lubricated with a solid or thin film lubricant of a type having a molecule with marked polar activity such as one with a long carbon chain (e.g., Palmitic or Oleic Acid) terminated by an unsaturated carboxyl group (e.g., $CO_2H$), or an unsaturated hydrocarbon distillate. However, the unbalanced and relatively high forces applied by the rollers of the chain against their cross axis call for a grease-type lubricant. Moreover, the shearing contact between the teeth of the driving sprockets and the outside surface of the beads can benefit from the bearing pressure provided by a grease as well as an adsorbed layer of a thin-film lubricant.

A practical, if not efficient, compromise practiced in the prior art consists of lubricating the bicycle chain by dipping it in melted paraffin, wiping the excess lubricant with a rag, then letting the paraffin solidify into a non-tacky film. This approach has some serious limitations, the most obvious being the fact that the chain can only be serviced when off the bicycle. More significant, however, are the facts that paraffin has a poor water tolerance and can disintegrate into flakes when contacted by a small amount of moisture, and, second does not provide a very effective lubricant for the internal and external surface of the rollers and their axles which are subject to both high pressures and shearing forces.

In addition, mechanisms such as bicycle chains often can become wet through rain, cleaning with water or water-based cleaning agents, even cleaning with non-dry compressed air, just prior to an attempt to apply lubrication. Typically, many lubricants cannot penetrate ambient water held by capillary action on the various surfaces of the chain. As the water evaporates, portions of the chain may be left un-contacted by lubricant. Solid lubricants cannot then flow into un-contacted areas. Although instructing the product user that the chain must be dry before applying the lubricant eliminates most of the problem, it is inconvenient for the user.

Accordingly, there is a need for a multi-functional lubricant specifically formulated to allow application on wet or dry bicycle chains and similar mechanisms operating in dusty or wet environments such as powered or manually driven household, gardening, farming, construction and industrial equipment.

SUMMARY OF THE INVENTION

It is an initial object of this invention to provide a dry, water-resistant, and environmentally safe lubricant for use on low to moderate speed and low to moderately high temperature mechanisms which are typically exposed to dirt particles. Examples of such mechanisms include bicycle chains, household items such as kitchen and garden appliances. Other examples include mechanisms which operate near combustion engines or other heat sources, such as mechanisms found on motorcycles, powered lawn equipment, farm equipment, forklifts, and other industrial or construction equipment.

It is a further object of this invention to provide a lubricant that will not attract or retain dirt particles, but will instead slough them off the mechanism while exhibiting good penetration and loading of bearing surfaces.

It is a further object of this invention to provide a lubricant in which the rate of the sloughing action may be adjusted by changing the concentration or character of a component.

It is a further object of this invention to provide a lubricant which can be applied to mechanisms which are wet or dry.

It is a further object of the invention to provide a lubricant which may be applied under cooler temperature conditions.

These and other valuable objects are achieved by particles of an insoluble chemical bond weakening agent dispersed in a volatile solvent-based solution of: a wax and an oil. A surfactant may be added to the solution to allow the lubricant to displace water encountered on wet surfaces.

After evaporation of the solvent, the mixture of wax and oil provide a good penetrating and metal healing protective film. Any import of dirt particles combine with the bond weakening agent particles to break-down the chemical bond between some of the wax and the oil. Thus forming dirt-carrying flakes that fall off the mechanism. The rate of sloughing may be adjusted by combining soluble waxes having different crystalline structures. The amount of solvent may be adjusted or eliminated depending on the application. If a surfactant is used, the solid formed after solvent evaporation surrounds the surfactant, deactivating it. In this way, the surfactant will not aid subsequent removal of the lubricant from the chain with water.

DESCRIPTION OF THE PREFERRED EMBODIMENT OF THE INVENTION

The preferred embodiment of the invention addresses the various requirements of an effective lubricant for bicycle chains and other similar mechanisms by combining three different types of anti-wear and anti-friction elements. These elements are combined with a volatile solvent and a surfactant for ease of application to both wet and dry mechanisms, and to form a thin, penetrating multi-functional film over the entire mechanism.

The first component is a soluble wax having a melting point between approximately 41 and 73 degrees Celsius (100° F.–162° F.) from about 6 to about 35 percent per total weight. For most applications, a paraffin or slack wax with a melting point of about 46 degrees Celsius (116° F.) is preferred because of its high solubility in hydrocarbon solvents. In its solid state, wax forms a good bearing lubricant without the dirt-gathering character of greases. Besides paraffin waxes, microcrystalline, hydrogenated triglycerides, natural and synthetic spermaceti, and natural or synthetic waxes with similar melting point characteristics could be used, albeit at a higher cost. Alternately, the first component may be a combination or blend of soluble waxes having different crystalline structures to obtain modified performance characteristics, as will be described later.

The second component is approximately 0.3 to approximately 20 percent per total weight of a hydrocarbon, silicone, or non-oxidizing vegetable or animal oil or grease, preferably petroleum jelly (petrolatum), 10 to 30 weight lubricating oil, synthetic silicone oil, or jojoba oil. For the sake of clarity, these oil and grease candidates will be referred to collectively as the oil component in this specification. For most applications the preferred range should fall within about 2 to 15 percent per total weight. The oil provides a penetrating lubricant as well as an adsorbable metal-healing film. The relatively low concentration of the oil component does not substantially increase the viscosity of the end product. The ability of these oils to be partially adsorbed by the metallic surface is believed to be a necessary compliment to the load-bearing characteristic of the wax element.

These two first elements are dissolved in a volatile solvent preferably selected from a group of straight-chain hydrocarbons having from 5 to 8 carbon atoms, and boiling points between about 35 and 110 degrees Celsius (95° F.–230° F.), or aromatic hydrocarbons such as Toluene and Xylene or from chlorinated hydrocarbon solvents such as Perchloroethylene, as well as Naphthas, Pentane and Hexane, or turpentine. The toxicity of Toluene and Perchloroethylene make them unavailable for certain applications. Pentane with a boiling point of about 35.5 degrees Celsius is difficult to store and handle under most ambient conditions. Hexane, because of its low cost, low toxicity and high solubility is the preferred choice. The solvent is simply a carrier which vaporizes shortly after application of the lubricant, and is therefore not considered to be one of its basic components. Therefore, any solvent or solvent blend which has a wax, oil and grease dissolving capability and is compatible with the particulate insoluble bond weakening agent component described below would be suitable. Depending on the application, the range for the concentration of the solvent component is about 35 to 90 percent per total weight of pre-application lubricant.

The next component of the lubricant is approximately 5 to 25 percent per total weight of a particulate, relatively insoluble chemical bond weakening agent. The preferred agent will have some degree of inherent lubricity, so that it is capable of operating as a stand alone dry lubricant. In this way, the agent acts as a secondary lubricant as the present, primary lubricant breaks down. The agent should be relatively insoluble with respect to the solution of the solvent, wax and oil components described above. Finally, the agent should exist or should be capable of being manufactured in small particles ranging preferably from about 0.5 to about 50 microns.

Agents meeting these requirements are particles of materials such as talc, graphite, boron nitride, paint grade aluminum powder, metallic soaps and polytetrafluoroethylene and other fluorinated hydrocarbons such as those available under the brand name of TEFLON® which exhibit the characteristics described above. Other possible candidates which have not been tested are buckminsterfullerines. Although certain types of ash or diatomaceous earth can be used, they do not have adequate inherent lubricity and are therefore not preferred.

The most preferable agent with respect to lubricating bicycle chains and similar mechanisms is a water-repellent salt from the reaction of a fatty acid preferably selected from a group of Stearic, Oleic, Linoleic, or Palmitic acids, with a metal, preferably a metal of Group II and above on the periodic table, more, preferably selected from a group consisting of Aluminum, Barium, Calcium, Lithium, Magnesium, and Zinc. All the metallic soaps such as Naphthenate and Laurates, although not tested, are expected to be adequate. Calcium Stearate appears to be the most economical and practical choice.

Most of these agents, particularly finely powdered polytetrafluoroethylene (TEFLON®), boron nitride, aluminum powder, and the metallic soaps, are excellent dry lubricants in their own right under the typical conditions subjected to bicycle chains. However, by themselves, they lack the metal-to-metal healing ability necessary to provide for long, continuous use. They provide solid loading and extend the working life of the present lubricant, but maintain a relatively low viscosity. The finely divided particles of agent suspended in the solution provide a large surface area of adhesion for the wax and oil components without becoming greasy, thus maintaining the dry, water and dirt-repelling character of the lubricant.

It should be noted that combining two or more agents may produce a lubricant more suited to specific applications.

The next component is a surfactant which allows the lubricant to be applied to wet surfaces. The inclusion of this component is therefore optional depending on whether this feature is desired. When used, the concentration of surfactant should range from approximately 0.03 to 2.0 percent per total weight of lubricant. The surfactant reduces the surface tension of the lubricant, allowing it to penetrate into any ambient water adhering to the various surfaces of the chain. The surfactant makes the lubricant, while in liquid form, hydrophilic. Therefore, ambient water is absorbed into the liquid lubricant, and is thereby displaced by it. The solvent and water then evaporate, leaving a mixture of wax, oil and insoluble bond weakening agent particles to form the solid lubricating film. The surfactant can be added to the solvent at any point during mixture of the components, either before the solvent is added or after. One embodiment of the lubricant includes the bond weakening agent within a range of 10 to 20 percent per total weight; the soluble wax within a range of 14 to 25 percent per total weight; the oil component within a range of 4 to 10 percent per total weight; the volatile solvent within a range of 50 to 75 percent per total weight; and the surfactant within a range of 0.1 to 1.5 percent per total weight.

An important feature of the invention is the deactivation of the surfactant as the lubricant becomes solid. As the solvent evaporates, the wax and oil form a matrix which encapsulates the surfactant with respect to any subsequently added water. In this way, the surfactant will not adversely affect the water-repelling nature of the solidified lubricant. In other words, even though the surface-active agent is still present, it is inactive, and the solventless lubricant will be hydrophobic.

Although numerous types of commercially available surfactants compatible with the other components and miscible with the solvent carrier are acceptable, the preferred surfactant is Octyphenoxypolyethoxyethanol-nonionic which is available under the brand name TRITON X 100® from Union Carbide, Danbury, Conn. This type of surfactant is preferred because it works well at low concentrations and is inexpensive.

Another important feature of the invention is the self-cleaning effect provided by the insoluble, particulate bond weakening agent component. In its finely divided form, the agent weakens the cohesive bond of the wax and oil components. The bonds between, for example, paraffin and petrolatum are so weakened by contact with the particle of polytetrafluoroethylene (TEFLON®) or metallic soap that the introduction of a small amount of additional material such as dust or dirt will cause the integrity of part of the solid lubricant to disintegrate into small particles that flake away from the unaffected part of the lubricant. In that process, the bulk of the dust or dirt is sloughed away. The above-described phenomenon insures that even the most inaccessible areas of the lubricated surfaces are maintained in clean condition.

EXAMPLE 1

About 13.6 percent per total weight of Calcium Stearate is dispersed in a solution of about 6.3 percent of total weight of Petrolatum (petroleum jelly) and about 17.1 per percent of total weight of paraffin wax having a melting point of about 46.6 degrees Celsius (116° F.) with about 62.6 percent per total weight of Hexane and about 0.4 percent per total weight of Triton X 100® brand surfactant. After thorough mixing, the formulation was applied to all areas of a bicycle chain, and the excess wiped off with a rag. The formulation was allowed to dry to a solid, non-tacky film.

The Calcium Stearate component of the above example may be replaced with and equal amount by weight of Boron Nitride or powdered polytetrafluoroethylene (TEFLON®) having particle sizes of about 3 to about 7 microns.

EXAMPLE 2

Approximately 3.5 percent per total weight of Calcium Stearate and about 3.5 percent per total weight of Aluminum powder having a particle sizes from about 2 to about 6 microns dispersed in a solution of about 2 percent per total weight of 10 weight petroleum distillate lubricating oil, and about 10 percent per total weight of paraffin wax with a melting point of around 74 degrees Celsius (135° F.) dissolved in approximately 80 percent per weight of Perchloroethylene and approximately 1 percent per total weight of Triton X 100® surfactant.

EXAMPLE 3

Approximately 8 percent per total weight of Calcium Oleate and 7 percent per total weight of graphite having particle sizes from about 10 to about 25 microns suspended in a solution of about 5 percent per total weight of a 30 weight motor oil and about 18 percent per total weight of a paraffin wax with a melting point of around 49 degrees Celsius (120° F.) with a mixture of about 25 percent per total weight of Toluene, about 35 percent per total weight of Varnish Makers & Paints grade of Naphtha and about 2 percent per total weight of surfactant.

EXAMPLE 4

Approximately 15.3 percent per total weight of powdered Teflon having particle sizes of about 3 to about 7 microns suspended in a solution of about 6.9 percent per total weight of jojoba oil and about 19.4 percent per total weight of a paraffin wax with a melting point of around 46.7 degrees Celsius (116° F.) with a mixture of about 58 percent per total weight of Hexane, and about 0.4 percent per total weight of Triton-X 100® brand surfactant.

EXAMPLE 5

Approximately 12.5 percent per total weight of Calcium Stearate suspended in a solution of about 8.0 percent per total weight of silicone oil (350 centipoise) and about 14.0 percent per total weight of a paraffin wax with a melting point of around 46.7 decrees Celsius (116° F.) with a mixture of about 65.2 percent per total weight of commercial paint grade turpentine, and about 0.3 percent per total weight of Triton-X 100® brand surfactant.

The rate at which the lubricant sloughs from the chain determines, to a large degree, how long an application of the lubricant lasts. Control of the sloughing rate can be accomplished by blending soluble waxes having different solid phase crystalline structures. It has been found that a blend of paraffin wax and microcrystalline wax will reduce the rate at which the lubricant will slough from the chain. This, in turn, extends the useful life of a single application of lubricant. It is thought that the addition of the microcrystalline wax modifies the crystalline structure of the paraffin wax base as it solidifies. Other waxes having amorphous or crystalline structures different from paraffin such as natural and synthetic spermaceti, and hydrogenated triglycerides, although not tested, are expected to be adequate. Microcrystalline wax having a melting point between approximately 55 and 85 degrees Celsius (about 130° F.–185° F.) appears to be the most economical and practical choice. When using a paraffin/microcrystalline blend, the blend should be about 75 to about 99% paraffin by weight, the rest being microcrystalline. Example 6 below utilizes this type of wax blend.

EXAMPLE 6

Approximately 15.3 percent per total weight of Calcium Stearate is disbursed in a solution of about 6.9 percent per total weight of petrolatum, about 17.4 percent per total weight of paraffin wax having a melting point of about 116° F. and 2.0 percent microcrystalline wax having a melting point of around 182° F. with about 58 percent per total weight of Hexane and about 0.4 percent per total weight of triton X 100 brand surfactant. In this example, the addition of the microcrystalline wax to the formation extends the useful life of an application of the lubricant between 20 and 30 percent over that of the formulation in Example 1.

Examples 1–6 are designed to work optimally in low-heat applications, such as bicycle chains. The following Example 7 is designed to be used on mechanisms which operate at moderately high temperatures such as: motorcycle chains, powered gardening equipment, farm equipment, forklifts, and other industrial equipment.

EXAMPLE 7

About 5.0 percent per total weight of Calcium Stearate is dispersed in a solution of about 0.3 percent per total weight of Petrolatum (petroleum jelly) and about 6.0 per percent of total weight of paraffin wax having a melting point of about 70.5 degrees Celsius (159° F.) with about 88.7 percent per total weight of Hexane. This formulation provides a dry lubricant which remains solid up to 68.3 degrees Celsius (155° F.). A typical use would be a motorcycle pivot point in close proximity to the engine where heavy lubricant solid loading is not as important as having a dry, dirt-resistant, self-cleaning lubricant.

The solubility of the components, particularly the wax component, within the solvent carrier is temperature dependent. Therefore, there is a trade-off between the solid loading of the pre-application lubricant and the lowest temperature at which the lubricant may be applied to the mechanism. In other words, the higher the application temperature, the more wax/oil/bond weakening agent can be present in the lubricant. The preferred formulation will then depend on how the lubricant is to be used.

The preceding examples provide a lubricant which may be applied over a wide range of temperatures, between approximately 15 and 50 degrees Celsius (about 60° F.–120° F.). If application is to occur in a more controlled environment having a temperature range between about 27 and 50 degrees Celsius (about 80° F.–120° F.), the solids content of the lubricant in its pre-application form can be increased by up to 50 percent as in the following Example 8.

EXAMPLE 8

About 22.7 percent per total weight of Calcium Stearate is dispersed in a solution of about 10.3 percent of total weight of petrolatum and about 29.1 per percent of total weight of paraffin wax having a melting point of about 46.7 degrees Celsius (116° F.) with about 37.3 percent per total weight of Hexane and about 0.6 percent per total weight of Triton-X 100® brand surfactant.

Conversely, bicycles and farm equipment stored outdoors during winter months require a lubricant which can be applied at lower temperatures as in Example 9 in which the application temperature can be as low as about 1.6 degrees Celsius (35° F.).

EXAMPLE 9

About 12.4 percent per total weight of Calcium Stearate is dispersed in a solution of about 5.9 percent of total weight of petrolatum and about 8.8 per percent of total weight of paraffin wax having a melting point of about 46.7 degrees Celsius (116° F.) with about 72.6 percent per total weight of Hexane and about 0.3 percent per total weight of Triton-X 100® brand surfactant.

Although the preferred embodiment uses a volatile solvent to allow the lubricant to be easily applied and to adequately penetrate complex mechanisms, it is possible for the lubricant to be applied without solvent. The lubricant may be created in solid block or stick form and applied to the mechanisms by rubbing. Alternately, the lubricant may be applied in a hot, melted form. Clearly, however, these methods offer limited coverage and penetration.

While the preferred embodiment of the invention has been described, modifications can be made and other embodiments may be devised without departing from the spirit of the invention and the scope of the appended claims.

What is claimed is:

1. A multi-functional, light duty lubricant comprising:

an insoluble particulate chemical bond weakening agent comprising one or more of talc, graphite, polytetrafluoroethylene, solid fluorinated hydrocarbons and boron nitride within a range of approximately 5 to approximately 25 percent per total weight, in suspension in a solution of:

a soluble wax having a melting point between approximately 41° C. and approximately 85° C. within a range of approximately 6 to approximately 35 percent per total weight;

an oil component having a percent per total weight that is less than the percent per total weight of the soluble wax, wherein the oil component comprises a hydrocarbon oil, silicone oil, vegetable oil, animal oil or grease prepared therefrom; and a volatile solvent within a range of approximately 35 to approximately 90 percent per total weight.

2. The lubricant of claim 1, wherein said bond weakening agent comprises particles having a size between about 0.5 and 50 microns.

3. The lubricant of claim 1, which further comprises:

a surfactant within a range of approximately 0.03 to approximately 2.0 percent per total weight.

4. The lubricant of claim 1, wherein said lubricant has properties such that when said solvent evaporates, a bond is formed between a portion of said wax and a portion of said oil component, said bond being weakened by a portion of said bond weakening agent.

5. The lubricant of claim 4, wherein said bond is weakened to a point whereby said bond is breakable through contact with a foreign dirt particle.

6. The lubricant of claim 1, wherein said solvent is selected from a group consisting of straight-chain hydrocarbons having from 5 to 8 carbon atoms and boiling points between approximately 35° C. and approximately 110° C., aromatic hydrocarbons, chlorinated hydrocarbon solvents and turpentine.

7. The lubricant of claim 1, wherein said hydrocarbon oil and grease prepared therefrom is a lubricating oil distillate.

8. The lubricant of claim 1, wherein said wax is selected from the group consisting of paraffin wax, microcrystalline wax, hydrogenated triglycerides, synthetic spermaceti and natural waxes.

9. The lubricant of claim 1, which comprises:

Polytetrafluoroethylene in suspension in a solution of paraffin wax, Petrolatum and Hexane.

10. The lubricant of claim 1, which comprises:

polytetrafluoroethylene in suspension in a solution of paraffin wax, Petrolatum and turpentine.

11. The lubricant of claim 1, which further comprises:

polytetrafluoroethylene in suspension in a solution of paraffin wax, lubricating oil and Perchloroethylene.

12. The lubricant of claim 1, which comprises polytetrafluoroethylene in suspension in a solution of paraffin wax, motor oil, Toluene and Varnish Makers & Paints grade of Naphtha.

13. The lubricant of claim 3, wherein:

said bond weakening agent is within a range of 10 to 20 percent per total weight;

said soluble wax is within a range of 14 to 25 percent per total weight;

said oil component is within a range of 4 to 10 percent per total weight;

said volatile solvent is within a range of 50 to 75 percent per total weight; and said surfactant is within a range of 0.1 to 1.5 percent per total weight.

14. The lubricant of claim 1, wherein said soluble wax is a wax blend comprising:

a first wax having a first solid phase crystalline structure;

a second wax having a second solid phase amorphous or crystalline structure; and wherein said first and second structures are different.

15. The lubricant of claim 14, wherein said blend comprises at least 75% by weight of said first wax.

16. The lubricant of claim 15, wherein said first wax has a melting point of between approximately 41 and approximately 73 degrees Celsius; and wherein said second wax has a melting point of between approximately 55 and approximately 85 degrees Celsius.

17. A multi-functional light-duty lubricant comprising:

an insoluble particulate bond weakening agent within a range of approximately 5 to approximately 25 percent per total weight, in suspension in a solution of:

an oil component within a range of approximately 0.3 to approximately 20 percent per total weight, selected from the group consisting of:

hydrocarbon oils and greases prepared therefrom; silicone oils and greases prepared therefrom; and vegetable oils and greases prepared therefrom;

a volatile solvent within a range of approximately 35 percent to approximately 90 percent per total weight; and a soluble wax blend within a range of approximately 6 to approximately 35 percent per total weight, said blend comprising:

a first soluble wax having a first solid phase crystalline structure; and a second soluble wax having a second solid phase amorphous or crystalline structure different from said first structure.

18. The lubricant of claim 17, wherein said first soluble wax comprises a paraffin wax having a melting point between approximately 41° C. and approximately 73° C.

19. The lubricant of claim 18, wherein said second soluble wax is selected from the group consisting of microcrystalline wax, hydrogenated triglycerides, synthetic spermaceti and natural waxes.

20. The lubricant of claim 18, wherein said second wax comprises a microcrystalline wax having a melting point between approximately 55° C. and approximately 85° C.

21. The lubricant of claim 17, wherein said blend comprises at least 75% by weight of said first wax.

22. The lubricant of claim 17, wherein said solvent is selected from a group consisting of straight-chain hydrocarbons having from 5 to 8 carbon atoms and boiling points between approximately 35° C. and approximately 110° C., aromatic hydrocarbons, chlorinated hydrocarbon solvents and turpentine.

23. The lubricant of claim 17, wherein said bond weakening agent is selected from the group consisting of:

insoluble soaps, talc, graphite, polytetrafluoroethylene, boron nitride, and paint grade aluminum powder.

24. The lubricant of claim 23, wherein said insoluble soaps comprise a metal salt of a fatty acid, wherein the fatty acid is stearic, oleic, linoleic or palmitic acid, and wherein the metal is Aluminum, Barium, Calcium, Lithium, Magnesium or Zinc.

25. The lubricant of claim 17, wherein said hydrocarbon oils and greases prepared therefrom are lubricating oil distillates.

26. The lubricant of claim 17, which comprises:

polytetrafluoroethylene in suspension in a solution of paraffin wax, Petrolatum and Hexane.

27. The lubricant of claim 17, which comprises:

polytetrafluoroethylene in suspension in a solution of paraffin wax, Petrolatum and turpentine.

28. The lubricant of claim 17, which comprises:

polytetrafluoroethylene in suspension in a solution of paraffin wax, lubricating oil and Perchloroethylene.

29. The lubricant of claim 17, which comprises:

polytetrafluoroethylene in suspension in a solution of paraffin wax, motor oil, toluene and Varnish Makers & Paints grade of Naphtha.

30. The lubricant of claim 17, which further comprises a surfactant within a range of approximately 0.03 to approximately 2.0 percent per total weight.

31. A method for lubricating a mechanism which comprises contacting all areas of the mechanism with a mixture of approximately 5 to approximately 25 percent per total weight of an insoluble particulate bond weakening agent, in suspension in a solution comprising:

approximately 6 to approximately 35 percent per total mixture weight of a soluble wax blend of a first and second wax having different solid phase crystalline structures, said blend having a complete melting point between approximately 41° C. and approximately 85° C.;

approximately 0.3 to approximately 20 percent per total mixture weight of an oil component selected from the group consisting of:

hydrocarbon oils and greases prepared therefrom; silicone oils and greases prepared therefrom; and vegetable oils and greases prepared therefrom;

approximately 35 to approximately 90 percent per total mixture weight of a volatile solvent;

approximately 0.03 to approximately 2.0 percent per total weight of a surfactant; and allowing said mixture to dry.

32. The method of claim 31, wherein said bond weakening agent is selected from the group consisting of:

insoluble soaps comprising a metal salt of a fatty acid, wherein the fatty acid is stearic, oleic, linoleic or palmitic acid, and wherein the metal is Aluminum, Barium, Calcium, Lithium, Magnesium or Zinc;

talc;

graphite;

polytetrafluoroethylene;

boron nitride; and paint grade aluminum powder.

33. The method of claim 32, wherein said step of allowing said mixture to dry comprises:

allowing said volatile solvent to evaporate.

* * * * *